US005638547A

United States Patent [19]

Hewitt

[11] Patent Number: 5,638,547

[45] Date of Patent: Jun. 17, 1997

[54] COLLAR SYSTEM FOR A FIREFIGHTER'S COAT

[75] Inventor: Joyce A. Hewitt, Alton, N.H.

[73] Assignee: Globe Manufacturing Company, Pittsfield, N.H.

[21] Appl. No.: 545,909

[22] Filed: Oct. 18, 1995

[51] Int. Cl.[6] ..... A41D 13/00

[52] U.S. Cl. ..... 2/81; 2/82; 2/86; 2/87; 2/97; 2/98; 2/135

[58] Field of Search ..... 2/81, 82, 85, 86, 2/87, 93, 97, 98, 129, 135, 272

[56] References Cited

U.S. PATENT DOCUMENTS 4,604,759 8/1986 Bowman et al. ..... 2/81

4,748,691 6/1988 Grilliot et al. ..... 2/81

5,532,037 7/1996 Aumann ..... 2/135

*Primary Examiner*—Diana Biefeld

*Attorney, Agent, or Firm*—Watson Cole Stevens Davis

[57] ABSTRACT

An outer shell is stitched to an outer collar part which is in turn stitched to an inner collar part. A moisture barrier is stitched to and disposed between the inner and outer collar parts. A separate liner has an upper edge portion having fastening means thereon which cooperate with fastening means on the inner collar part and the moisture barrier for removably securing the upper edge portion of the liner to the inner collar part and the moisture barrier. The moisture barrier extends above and below the upper edge portion of the liner when the collar is in an upright position.

8 Claims, 3 Drawing Sheets

COLLAR SYSTEM FOR A FIREFIGHTER'S COAT

BACKGROUND OF THE INVENTION

The present invention relates to a collar system incorporated into a firefighter's coat. Such coats include an outer shell having a body portion and a collar portion. It is necessary to ensure that water-tight integrity is maintained at the juncture of the outer shell and the collar portion thereof to prevent the firefighter from getting wet when fighting fires wherein copious amounts of water are used which may splash onto the coat.

Another problem which occurs with firefighter's coats is that the thermal liners employed with such coats must be thoroughly washed and dried independently of the outer shell in order to provide a coat which is comfortable to use in firefighting operations. Accordingly, it is highly desirable to provide a liner which is removable from the shell and collar so as to enable cleaning protocols to be carried out.

Therefore, it is an objective of the invention to provide a coat which provides water-tight integrity at the juncture of the body portion of the shell and the collar portion of the coat, while providing a construction which permits a separate thermal liner to be removed from the body portion and the collar portion to be washed and dried when desired.

U.S. Pat. No. 4,507,806 discloses a construction wherein the collar portion of the coat is permanently secured to the thermal liner, and the collar portion is removably secured to an annular tab at the upper part of the body portion of the outer shell by hook and loop fastening means. This construction does not provide water-tight integrity between the collar portion and the annular tab. Furthermore, the liner cannot be separately washed and dried, but since the collar portion is permanently secured to the thermal liner, it is necessary to disconnect both the liner and collar portion from the body portion of the shell, and the liner and collar portion must be washed and dried together which is undesirable.

U.S. Pat. No. 4,604,759 discloses a construction wherein the outer shell, the collar portion, the thermal liner and a waterproof interliner are all permanently interconnected with one another by stitching. This arrangement provides water-tight integrity at the juncture of the outer shell and the collar portion, but the liner cannot be separated and individually washed and dried. Accordingly, the structure of this patent cannot accomplish the desired objectives of the present invention.

SUMMARY OF THE INVENTION

The invention includes an outer shell which is stitched to an outer collar part which in turn is stitched to an inner collar part. A moisture barrier is stitched to the inner and outer collar parts and includes a lower portion having inner and outer layers. A conventional liner has an upper edge portion with fastening means supported on opposite faces thereof. A fastening means is supported on the inner layer of the moisture barrier for engaging a fastening means on the outwardly facing side portion of the liner. A further fastening means is supported on the inner collar part for engaging a fastening means on the inwardly facing side portion of the liner.

The fastening means enables the liner to be completely removed from the shell and the collar portion of the coat. A moisture barrier is disposed outwardly of the upper edge portion of the liner and inwardly of the adjacent portion of the shell. The moisture barrier extends above and below the upper edge portion of the liner when the collar is in an upright position as employed when fighting fires. The moisture barrier ensures that if small amounts of water should seep through the stitching which connects the shell to the outer collar part, such water will run down the outer surface of the moisture barrier and the outer surface of the outer layer of the liner. The outer layer of the liner also provides a moisture barrier so that the moisture will run down this outer layer and drain from between the separated bottom edges of the shell and liner.

DESCRIPTION OF THE PREFERRED EMBODIMENT

Figure 1:
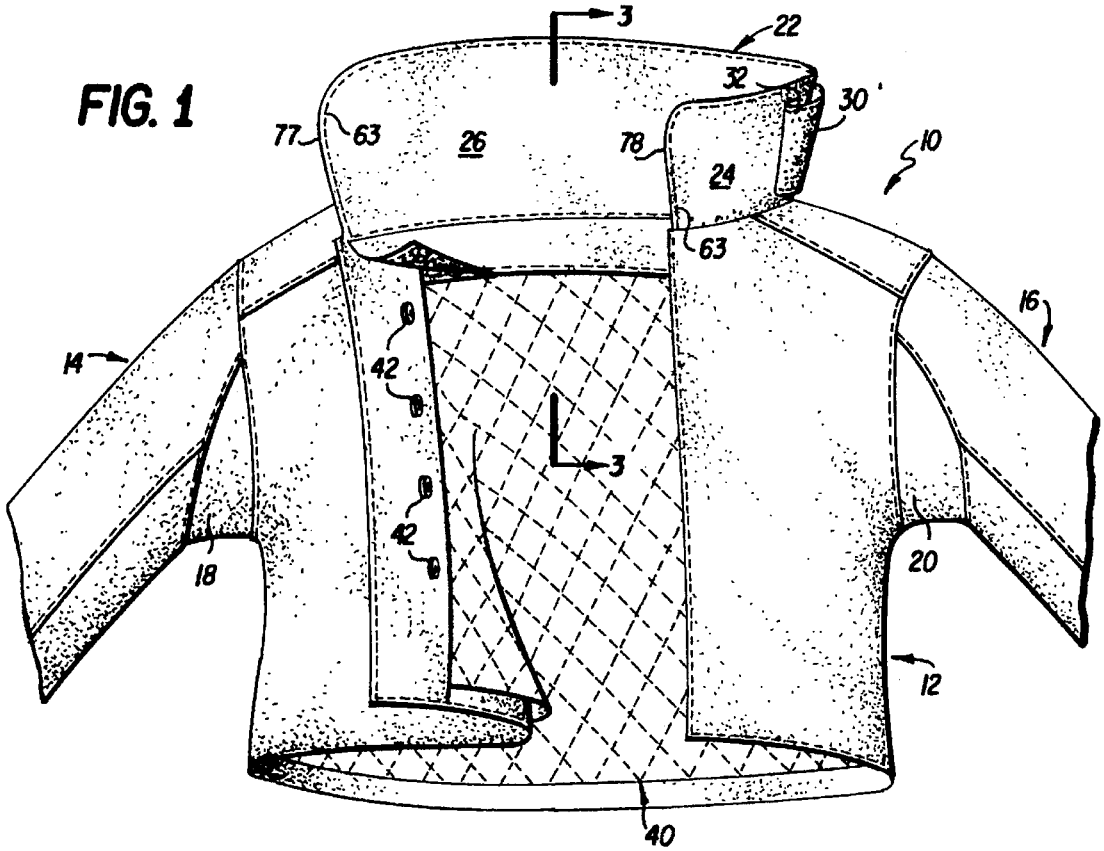
FIG. 1 is a front view of a firefighter's coat incorporating the collar system of the invention, and showing the coat in opened position.

Referring now to the drawings wherein like reference characters designate corresponding part throughout the several views, there is shown in FIGS. 1, 2, 5 and 6 a firefighter's coat 10 including a body or torso portion 12 having permanently stitched thereto a pair of sleeves 14 and 16 having the usual gussets 18 and 20 stitched thereto respectively. A collar portion 22 includes an outer collar part 24 and an inner collar part 26. A fastening means 28 in the form of hook and loop fastener such as VELCRO is stitched to the outer collar part 24. A throat tab 30 is stitched at one end 32 thereof to the outer collar part. A fastening means 34 such as VELCRO is stitched to one surface of the flap near the end 36 thereof and is adapted to engage fastening means 28 when the throat tab is in the stored position shown in FIG. 2. A fastening means 38 is stitched to the opposite surface of the flap near the end 36 thereof and is adapted to engage fastening means 28 when the throat tab is in the operative position shown in FIG. 6.

The coat is shown in open position in FIG. 1, it being understood that the coat may be secured in closed position with the use of a pair of VELCRO strips as shown in U.S. Pat. No. 4,604,759. A liner 40 is connected at the opposite vertical edges thereof to the opposite vertical edge portions of the shell by a plurality of conventional snap fasteners 42 mounted on the shell which engage conventional cooperating snap fasteners on the liner.

Figure 2:
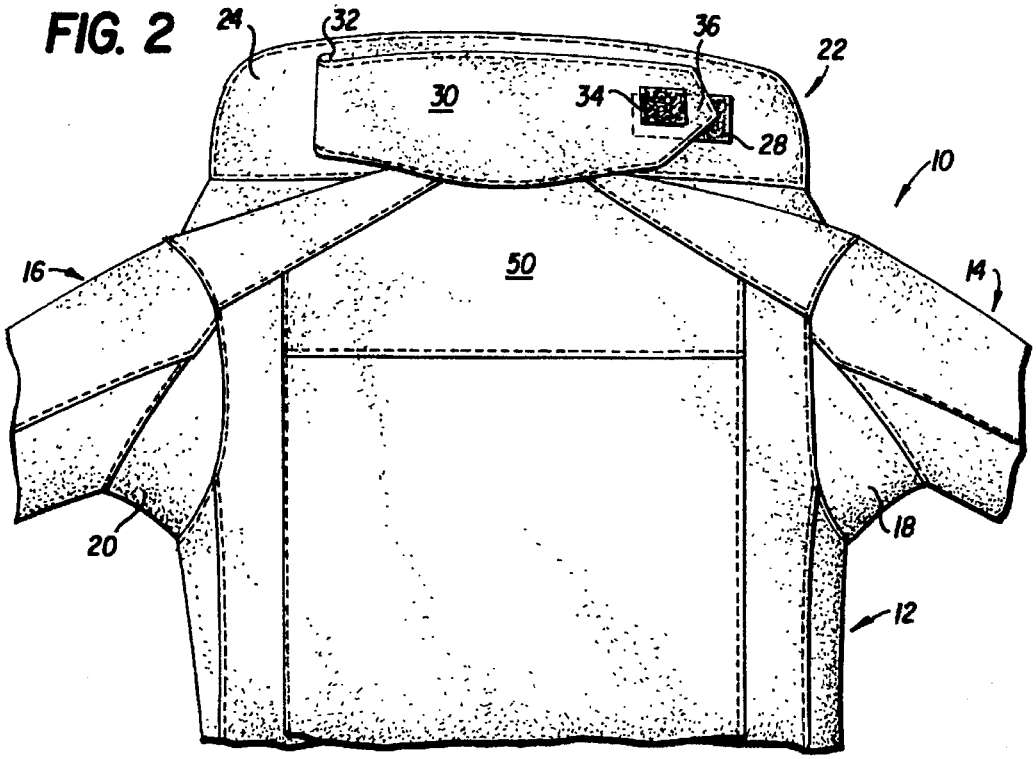
FIG. 2 is a back view of the coat shown in FIG. 1.
Figure 3:
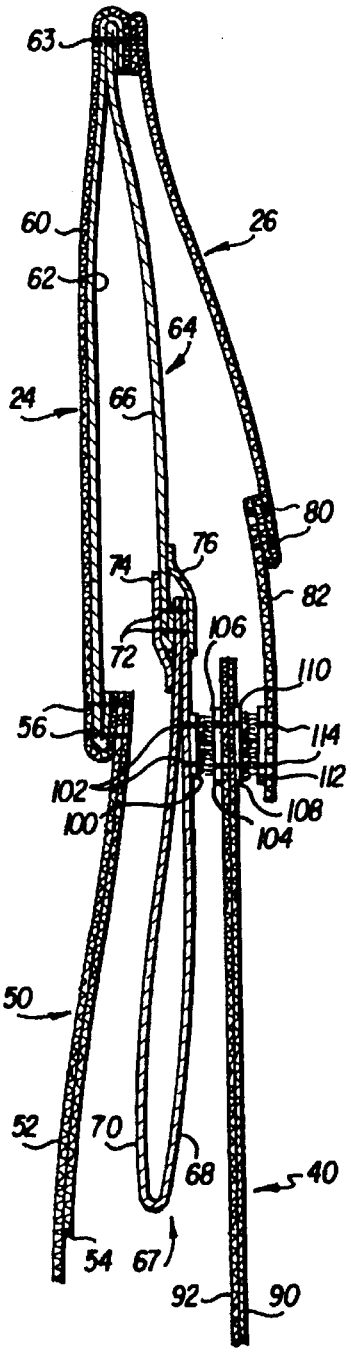
FIG. 3 is a sectional view on an enlarged scale taken on line 3—3 of FIG. 1.
Figure 4:
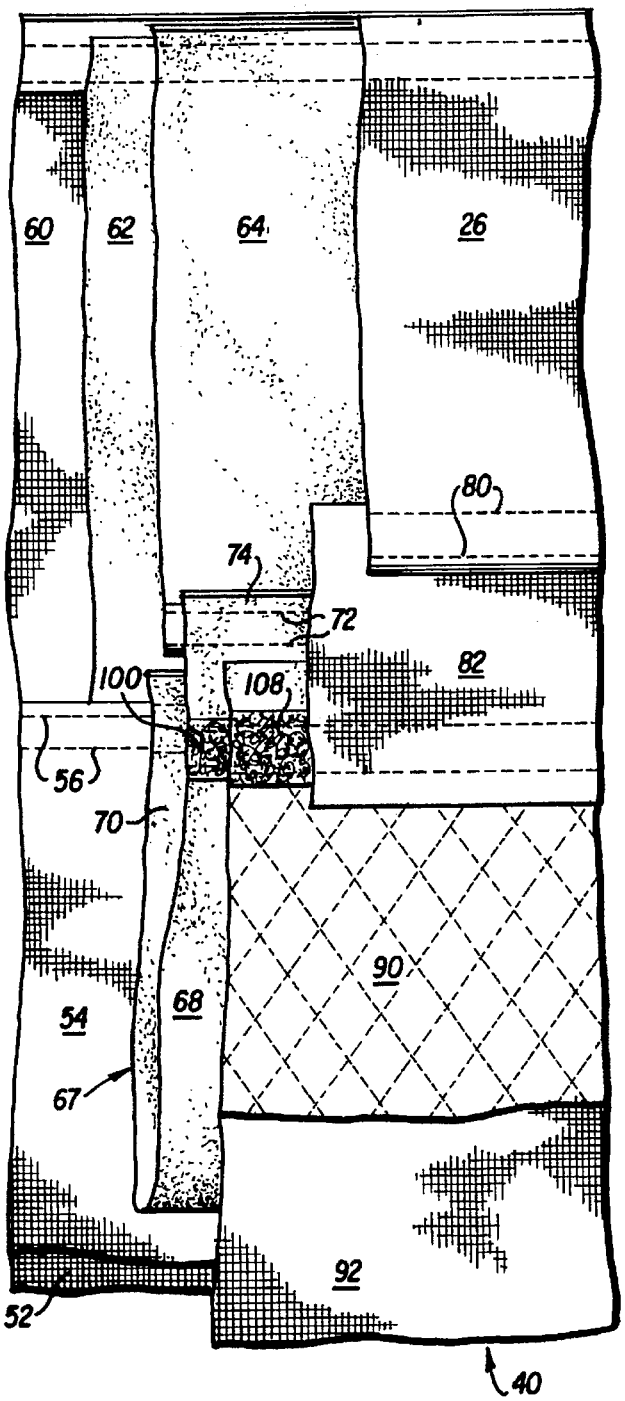
FIG. 4 is an broken-away view of the layers of material shown in FIG. 3 looking at FIG. 3 from the right side thereof
Figure 5:
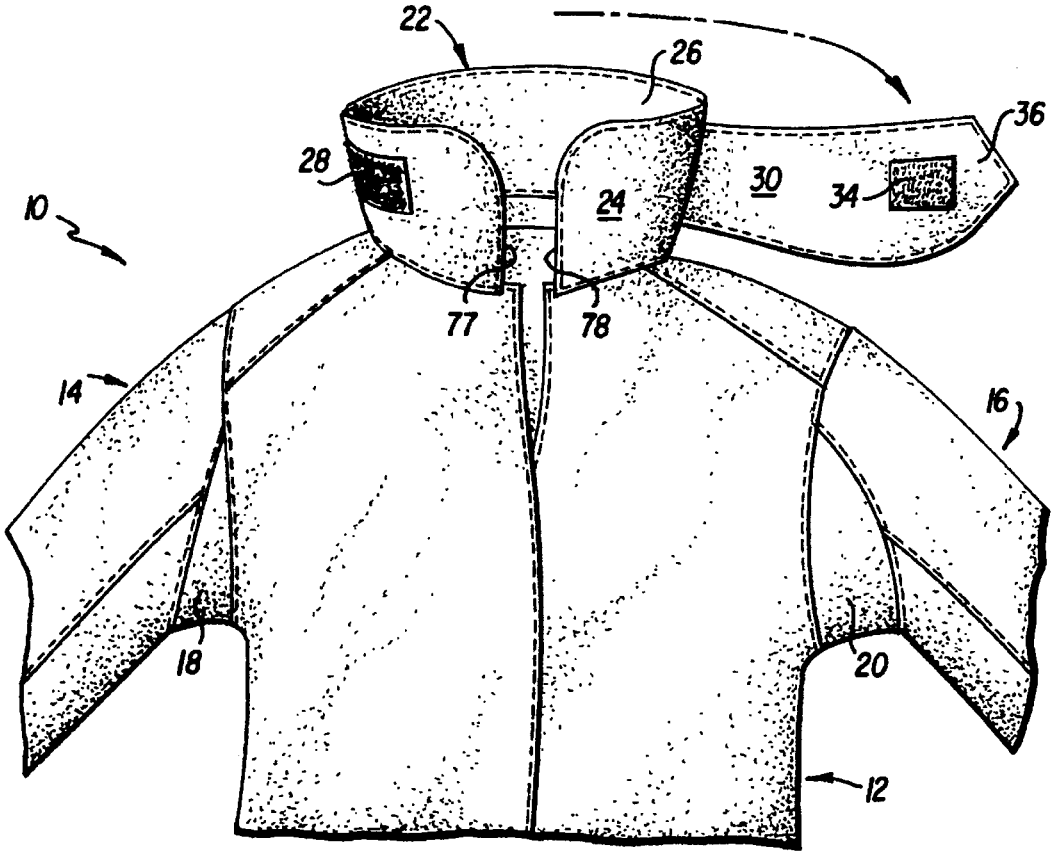
FIG. 5 is a front view of the coat showing the coat in closed position with the collar in upright position and the throat flap in open position.
Figure 6:
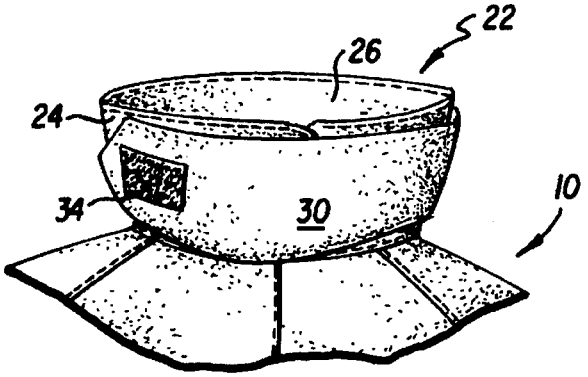
FIG. 6 is a view of the collar portion with the throat flap in closed position.

As seen in FIG. 2, the back of the coat includes an upper panel 50. Referring to FIGS. 3 and 4, the upper panel 50 includes two layers 52 and 54 of conventional flame-resistant material the upper edges of which are stitched at 56 to the lower edge of the outer collar part 24. The outer collar part includes an outer layer 60 and an inner layer 62. The outer layer 60 comprises the same material as the shell, and the inner layer 62 comprises a conventional moisture barrier formed of a neoprene-coated fabric. The waterproof neoprene-coated surface of the moisture barrier 62 faces outwardly toward layer 60.

The upper edge of the outer collar part 24 is stitched at 63 to the upper edges of a moisture barrier 64 and the inner collar part 26. The moisture barrier 64 includes an upper portion 66 formed of the same material as layer 62, and the waterproof surface thereof faces outwardly toward layer 60 of the outer shell. Inner collar part 26 is formed of a material similar to that of the outer shell.

Moisture barrier 64 also includes a lower portion 67 formed of the same material as portion 66. Portion 67 is looped to form inner and outer layers 68 and 70. The facing surfaces of layers 68 and 70 are fabric surfaces, while the waterproof surfaces of layers 68 and 70 face inwardly and outwardly respectively relative to the outer shell. The upper edges of layers 68 and 70 are stitched at 72 to the lower edge of portion 66 of the moisture barrier. Strips 74 and 76 of conventional waterproof tape are heat sealed to opposite surfaces of portions 66 and 67 to provide a waterproof joint adjacent the stitching 72.

The upper portion 66 of the moisture barrier extends laterally from one end of the collar to the other and is also stitched to the opposite end edges 77 and 78 of the collar as seen in FIG. 1 by stitching 63. The opposite end edges of the upper portion 66 extend below the bottoms of the opposite ends of stitching 63 so that any water which may seep through stitching 56 at the opposite ends of the collar will run down the outer surface of the moisture barrier. The opposite end edges of the lower portion 67 of the moisture barrier and the opposite end edges of the strips of tape 74 and 76 terminate short of the opposite end edges of the upper portion 66 so that the snap fasteners of the liner can be engaged with snap fasteners 42 on the shell.

Inner collar part 26 is stitched at 80 to a strip of material 82 which forms the lower portion of the inner collar part. Thermal liner 40 includes a conventional inner quilted layer 90 formed of thermal insulating material and an outer layer 92 of a similar construction to layer 66 to provide a moisture barrier. The waterproof surface of layer 92 faces inwardly toward layer 90.

A first connecting means 100 formed, for example, of VELCRO is stitched at 102 to the inner layer 68. It is desirable to stitch the connecting means in place, since this provides a superior support for the VELCRO. If the lower portion 67 of the moisture barrier were a single layer rather than a double layer, stitching fastening means 100 in place would be unsatisfactory since water could seep through the stitching. Accordingly, by providing a pair of layers 68 and 70, fastening means 100 can be stitched to the inner layer 68, while the outer layer 70 provides a waterproof moisture barrier between the inner surface of the shell and the upper edge portion of the liner.

A second connecting means 104 also formed of VELCRO is stitched at 106 to the upper edge portion of the liner 40. A third connecting means 108 also formed of VELCRO is stitched at 110 to the upper edge portion of the liner 40. A fourth connecting means 112 is stitched at 114 to the lower edge of portion 82 of the inner collar part 26. Fastening means 100 and 104 engage one another to connect the upper edge portion of the liner to the inner layer of the moisture barrier 64, while fastening means 108 and 112 engage one another to connect the upper edge portion of the liner to the lower edge of the inner collar part. While each of the fastening means is preferably VELCRO, other fastening means such as snap fasteners may also be employed.

The fastening means enable the liner to be readily disconnected from the moisture barrier and inner collar part when desired for washing and drying the liner. The liner is also disconnected from the shell by disconnecting the snap fasteners 42. The liner may be quickly and easily installed in operative position within the shell by connecting the snap fasteners 42 and engaging fastening means 100 and 104 with one another and engaging fastening means 108 and 112 with one another.

The outer neckline is defined by stitching 56, and the inner neckline is defined by stitching 80. If any water should seep through the stitching at 56, the moisture barrier 64 which extends both above and below the upper edge portion of the liner will present a waterproof surface to such water so that the water will flow downwardly by gravity between the moisture barrier and the outer shell and thence between the moisture barrier on the outer surface of the outer layer of the liner and the shell. The water will then drain from between the bottom edges of the liner and the outer shell which are separate from one another.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A collar system for a firefighter's coat comprising, a flame resistant shell including a body portion having left and right sleeve portions, a collar portion including an outer collar part and an inner collar part, said outer collar part being permanently secured to said body portion and to said inner collar part, a separate liner, said liner having an upper edge portion, a moisture barrier disposed between said outer and inner collar parts and between said upper edge portion of the liner and the adjacent portion of the shell, and fastening means for removably securing said upper edge portion of the liner to said inner collar part and said moisture barrier.

2. A collar system as defined in claim 1 wherein said moisture barrier comprises a lower portion which includes inner and outer layers, said fastening means including a first fastening portion supported by said said inner layer, and a cooperating second fastening portion supported by said upper edge portion of the liner.

3. A collar system as defined in claim 2 wherein said fastening means includes a third fastening portion supported by said upper edge portion of the liner, and a cooperating fourth fastening portion supported by said inner collar part.

4. A collar system as defined in claim 3 wherein said liner has opposite side portions, said second and third fastening portions being supported on different ones of said opposite side portions.

5. A collar system as defined in claim 1 wherein said moisture barrier extends above and below said upper edge portion of the liner when the collar is in an upright position.

6. A collar system for a firefighter's coat comprising, a flame resistant shell including a body portion having permanently secured thereto left and right sleeve portions and a collar portion, said collar portion including an outer collar part and an inner collar part, said collar parts each having an upper edge and a lower edge, said body portion including an upper edge which is stitched to the lower edge of said outer collar part to define an outer neckline, the upper edges of said inner and outer collar portions being stitched to one another, said collar portion including a moisture barrier supported between said inner and outer collar parts, a first fastening portion supported by said moisture barrier, a separate liner having an upper edge portion, means for supporting said liner within said body portion, said liner including inner and outer surfaces, a second fastening portion supported on said outer surface adjacent said upper edge portion of the liner, a third fastening portion supported on said inner surface adjacent said upper edge portion of the liner, a fourth fastening portion supported on the lower edge of said inner collar part, said first and second fastening portions engaging one another and said third and fourth fastening portions engaging one another for removably securing the upper edge portion of said liner to said collar portion.

7. A collar system as defined in claim 6 wherein said moisture barrier extends above and below said upper edge portion of the liner when the collar is in an upright position.

8. A collar system as defined in claim 6 wherein said moisture barrier comprises a lower portion which includes an inner layer and an outer layer, said first fastening portion being supported on said said inner layer.

* * * * *